United States Patent [19]

Kawachi

[11] Patent Number: 4,811,406

[45] Date of Patent: Mar. 7, 1989

[54] COMPOUND SPEAKER SYSTEM

[75] Inventor: Manabu Kawachi, Tokyo, Japan

[73] Assignee: Pioneer Electronic Corporation, Tokyo, Japan

[21] Appl. No.: 71,538

[22] Filed: Jul. 10, 1987

Related U.S. Application Data

[63] Continuation of Ser. No. 657,462, Oct. 4, 1984, abandoned, which is a continuation of Ser. No. 480,236, Mar. 30, 1983, abandoned.

[30] Foreign Application Priority Data

Mar. 31, 1982 [JP] Japan ..... 57-044965
Sep. 30, 1982 [JP] Japan ..... 57-147113

[51] Int. Cl.[4] ..... H04R 1/26; H04R 1/02

[52] U.S. Cl. ..... 381/186; 381/86; 381/87; 381/90; 381/182; 381/188

[58] Field of Search ..... 381/90, 88, 86, 87, 381/182, 186, 188, 192, 194, 205; 181/152, 154, 144, 147, 153

[56] References Cited

U.S. PATENT DOCUMENTS

| | | | |
|---|---|---|---|
| 2,259,907 | 10/1941 | Olney | 381/186 |
| 3,255,842 | 6/1966 | Vardeman | 181/147 |
| 3,754,618 | 8/1973 | Sasaki | 181/145 |
| 3,824,343 | 7/1974 | Dahlquist | 381/90 |
| 4,122,315 | 10/1978 | Schroeder | 181/147 |
| 4,178,473 | 12/1979 | Vermgren | 381/90 |
| 4,182,429 | 1/1980 | Senzaki | 181/144 |
| 4,289,929 | 9/1981 | Hathaway | 381/90 |
| 4,323,138 | 4/1982 | Horner | 181/147 |
| 4,365,113 | 12/1982 | Soma | 181/144 |
| 4,365,114 | 12/1982 | Soma | 181/144 |
| 4,441,577 | 4/1984 | Kurihara | 381/86 |
| 4,451,928 | 5/1984 | Murayama | 381/182 |
| 4,492,826 | 1/1985 | Chiu | 38/182 |
| 4,552,242 | 11/1985 | Kashiwabara | 381/182 |
| 4,553,630 | 11/1985 | Ando | 381/86 |

FOREIGN PATENT DOCUMENTS

| | | | |
|---|---|---|---|
| 538719 | 6/1955 | Belgium | 179/115.5 PS |
| 850927 | 10/1951 | Fed. Rep. of Germany | 179/115.5 PS |
| 1005386 | 4/1952 | France | 179/115.5 PS |
| 2413839 | 12/1977 | France . | |
| 36-23305 | 9/1961 | Japan . | |
| 54-180728 | 12/1979 | Japan . | |
| 2054323 | 2/1981 | United Kingdom | 179/115.5 PS |
| 2063618 | 6/1981 | United Kingdom | 179/115.5 PS |

*Primary Examiner*—Jin F. Ng
*Assistant Examiner*—Danita R. Byrd
*Attorney, Agent, or Firm*—Armstrong, Nikaido Marmelstein & Kubovcik

[57] ABSTRACT

A compound speaker system comprising a woofer, a squawker, a tweeter, and a super tweeter. The squawker, the tweeter, and the super tweeter are attached to a plate and the assembly is rotatably positioned within the cone of the woofer. Since the squawker, the tweeter, and the super tweeter are positioned at different distances from the axis of the assembly rotation, it is possible to design the system such that the speaker which reproduces relatively directional sound, such the tweeter or the super tweeter takes an elevated position as compared to the squawker when the assembly is rotated within the woofer cone.

17 Claims, 7 Drawing Sheets

COMPOUND SPEAKER SYSTEM

This application is a continuation of application Ser. No. 657,462 filed Oct. 4, 1984, now abandoned, which is a continuation of Ser. No. 480,236 filed Mar. 30, 1983, now abandoned.

BACKGROUND OF THE INVENTION

The present invention relates in general to a compound speaker system for mobile stereo systems and in particular to such a speaker suitable for use when located on rear seat package tray or in a door panel in the automobile compartment.

In most of the prior art compound speakers for mobile stereo systems, the woofer centers the squawker or the tweeter that is fixed on the support plate straddled over the frame of the woofer.

The output sound reproduced by the squawker and tweeter are highly directional mid-range and high frequency sounds. The layout of these conventional speaker systems is such that the sounds including the bass notes from the woofer are substantially on the same axis of propagation. This arrangement is in itself advantageous, but at the cost of loss of fidelity to the driver and other passengers. Namely, since the speakers produce sound in the direction of the ceiling, part of the mid-range and high frequency sounds is lost to the driver or passengers' ear.

SUMMARY OF THE INVENTION

The present invention has been proposed to overcome the above-mentioned problem. It is a principle object of this invention to provide a compound speaker system in which the squawker and the tweeter located almost centrally of the woofer are made rotatable to raised positions at angles with respect to the woofer. In addition, it is so designed that each raised position situates the tweeter at a higher point than the squawker. This speaker design provides high fidelity over the mid-range and high-frequency sounds. It is also an object of the invention to provide an angle adjustment mechanism for use in compound speakers system by which the vertical axis of the squawker and tweeter units can be varied in angle to change their sound transmission direction.

BRIEF DESCRIPTION OF THE DRAWINGS

The drawings illustrate preferred embodiments of the compound speaker system of the present invention in which.

DETAILED DESCRIPTION OF THE EMBODIMENTS

Figure 1:
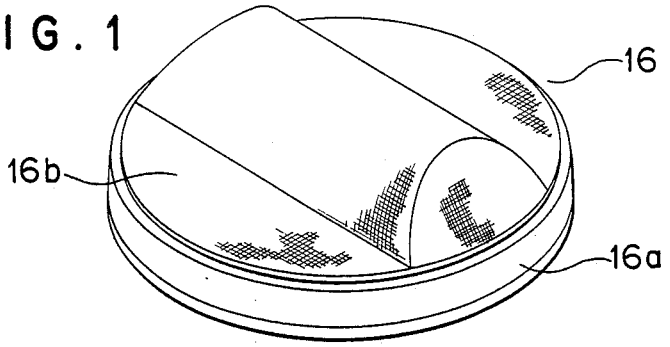
FIG. 1 is an exploded perspective view of one embodimemt of the invention.
Figure 1:
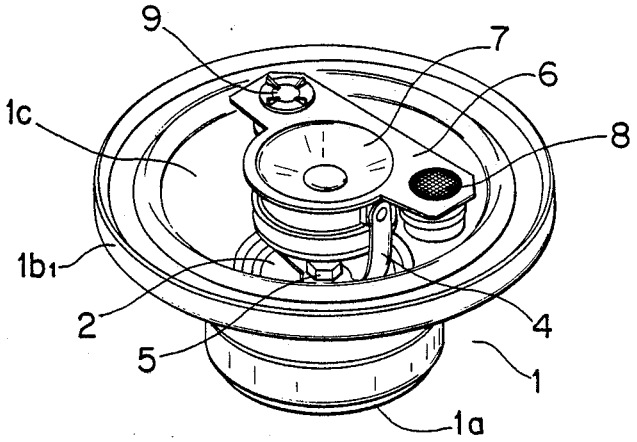

One preferred embodiment of the present invention will be described in conjunction with the attached drawings.

In the drawings, the woofer of this invention includes the following conventional elements; a pole piece 1*a*, a magnet $1a_2$, a plate $1a_3$, the cone frame 1*b*, the parabolic cone 1*c*, the bobbin 1*d*, the voice coil 1*e*, and the damper 1*f*.

Figure 2:
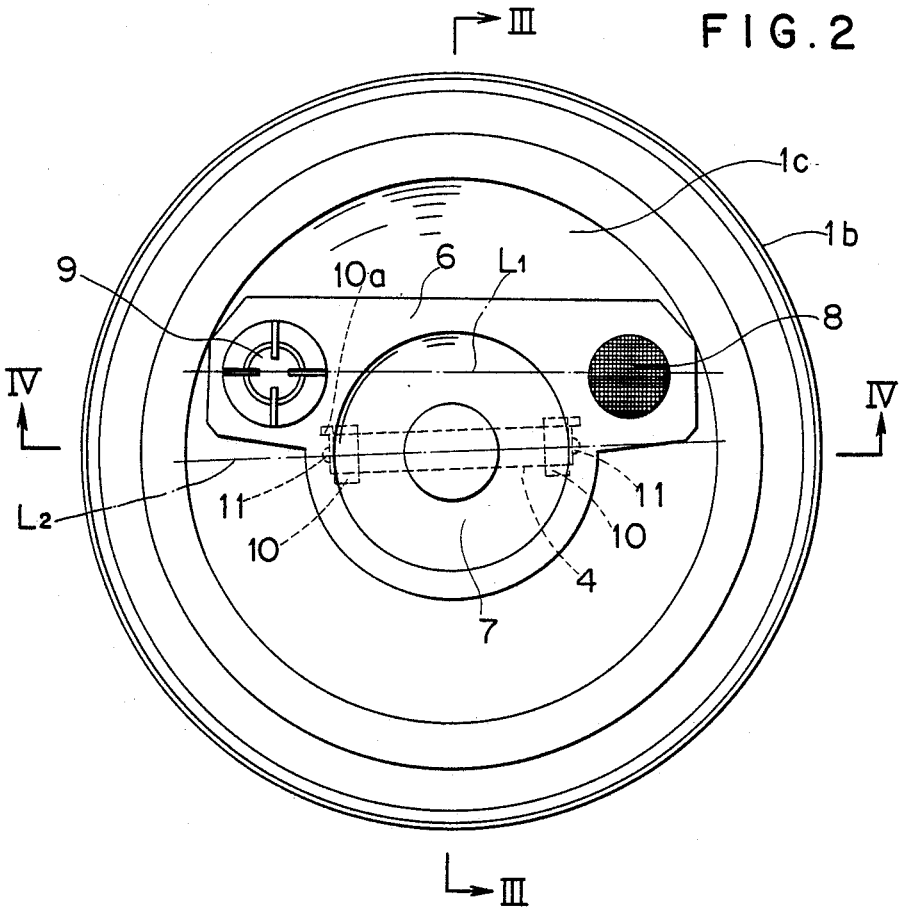
FIG. 2 is a plan view of the speaker system of FIG. 1 with a grille removed from the main body thereof.
Figure 4:
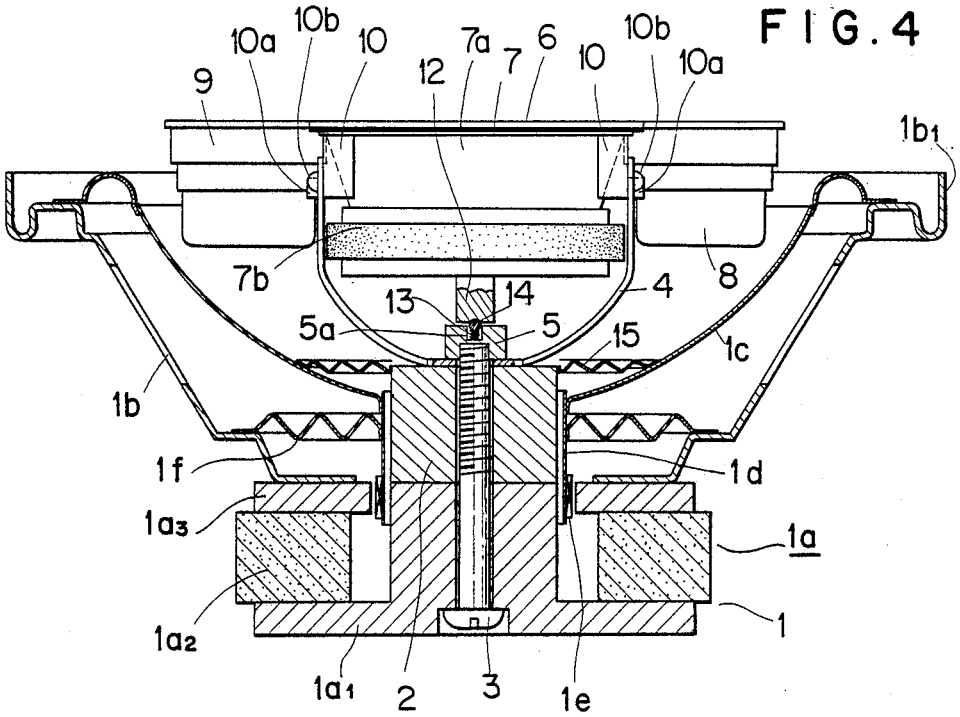

On top of the pole piece $1a_1$, forming part of magnetic circuit 1*a*, is disposed a base 2 of synthetic resin that is fixed in position by a screw 3 inserted from the bottom of the pole piece. On the base 2 is located a support arm 4 of largely U-shape (FIG. 4) that is secured in place by a nut 5 at the uppermost end of the screw 3. The nut 5 has a hole 5*a* bored in the upper surface thereof. A squawker 7, a tweeter 8, and a super tweeter 9 smaller than the woofer are secured on a mounting plate 6 to face in the same direction as the woofer. The arrangement is that the squawker 7 is interposed between the tweeter 8 and the super tweeter 9, the super tweeter 9 is positioned farther than the tweeter 8 from a plane in which an upper rim of the woofer extends while the squawker 7 is positioned on said axis. In other words, the squawker 7 is offset from both of them, as may be seen by the imaginary line L1 connecting the centers of the tweeter 8 and super tweeter 9 in FIG. 2, such that, when the mounting plate 6 is rotated into a raised position, they will be elevated higher than squawker 7 outside above said plane. The squawker 7 has fixer members 10 having a stopper 10*a* of synthetic resin at diametrically opposite points on the squawker cone frame 7*a*. The fixer members are pivotably secured to the upper ends of the support arm 4 by means of screws 11 such that the squawker 7 take various positions. This pivotal securing defines an axis of rotation of the squawker. The squawker 7 is located between the support arm 4 in such a manner that the line L1 connecting the centers of the tweeter 8 and super tweeter 9 and the line L2 connecting the upper ends of the support arm 4 would not be parallel and would intersect with a certain angle. Since the support arm 4 supports the cone frame of the squawker 7 by holding the upper portion thereof, the mounting plate 6 will not project excessively above the upper rim of the woofer 1. In this situation, in order to prevent the tweeter 8 or the super tweeter 9 from coming into contact with the cone 1*c* of the woofer 1, the parabolic shape is selected for the cone 1*c* of this particular embodiment. The numeral 12 indicates an arched lock plate that is fixedly mounted beneath the magnetic circuit 7*b* of the squawker 7. This arched lock plate has a number of equally spaced recesses 12a bored in the periphery thereof. The nut 5 has a spring 13 and a ball 14 in its hole 5*a*. It is so designed that the spring 13 pushes the ball 14 into one of the recesses 12*a* in the arched lock plate 12.

The numeral 15 indicates a second damper that is attached between the base 2 and the bottom of the cone 1*c*.

The numeral 16 designates a grille, which comprises a ring 16*a* for fitting over the peripheral portion 1*b*$_1$ of the woofer frame 1*b*, and a metal net cover 16*b* fixedly fitted over the ring 16*a*. The metal net cover 16*b* has a bulged portion laterally extending so as to avoid interference with the rotating speakers 7 through 9, when the mounting plate 6 is actuated.

Operation of the present invention of which the construciton has been stated above will now be described. When the speaker system is in the non-operated position where the mounting plate 6 as well as all the speakers 7 through 9 are positioned on a horizontal plane, as shown in solid line in the drawings, the stoppers 10*a* of the fixer member 10 are held against the support arm 4. Also, the ball 14 is held within the middle recess 12*a* in the lock plate 12, which holds the lock plate in a fixed position.

This speaker system may preferably be installed in a rear seat package tray in the automobile with the cone 1*c* of the woofer facing upward where the line L1 connecting the tweeter 8 and the super tweeter 9 would be parallel to the seats. When the mounting plate 6 is rotated to face the driver's seat, the system holds the respective speakers 7 to 9 with their cones oriented in the driver's direction. When the mounting plate is being rotated, the lock plate 12 allows the ball 14 to move out from its original recess 12*a* and skip over the other recesses so long as the mounting plate 6 is moved. When the hand is removed after setting the mounting plate in the required position, the ball 14 will locate itself in the corresponding recess 12*a* to lock the lock plate 12 again and hence the mounting plate.

Figure 3:
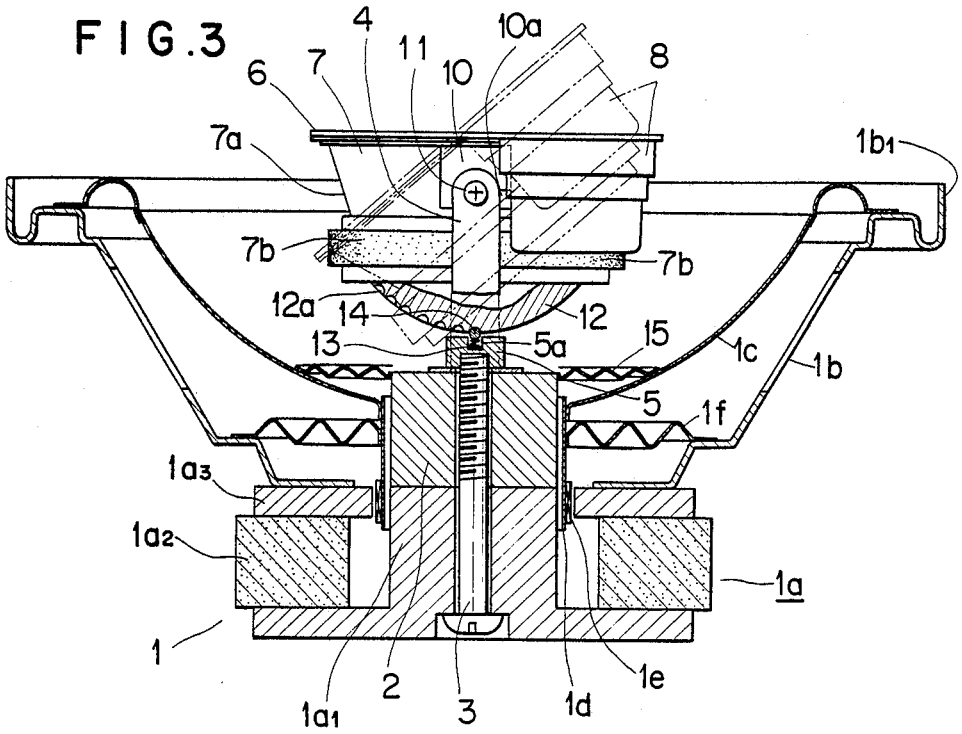
FIG. 3 and 4 are cross-sectional views taken along lines III—III and IV—IV of the FIG. 2.

When the mounting plate 6 is in the raised position indicated in broken line in FIG. 3 where the ball 14 is engaged in the farthest recess of the lock plate, the squawker 7 keeps its magnetic circuit 7*b* in contact with the nut 5. Since the nut 5 is magnetized through the screw 3, the engagement between the ball 14 and recess 12*a* in this position is further assured magnetically without becoming loose due to vehicle vibrations. This double assurance of fixation would be still more effective as the speaker system of this invention will be heard mostly in this most tilted position.

Further, when the speakers 7 through 9 are placed in the raised position, the speaker system holds the tweeter 8 and super tweeter 9 at a higher level than the squawker 7. Consequently, the highly directional high frequency sound reaches the driver's seat from somewhat elevated points in the compartment. In addition, in the raised position, the super tweeter 9 is situated relatively higher than the tweeter 8 in the speaker system because of the design that the line L1 connecting the centers of the tweeter 8 to the super tweeter 9 runs at a certain angle with the line L2 through the axis of rotation of the mounting plate. This arrangement permits super-high frequency sound to propagate from a higher point than the sounds from the tweeter 8. Therefore, substantially all of the sound ranges reach directly the driver without being blocked by possible obstructions within the automobile compartment such as a backrest pillow.

In the embodiment described above, the mounting plate 6 is attached to the support arm 4 through the fixer members 10 that hold the squawker 7 in position. However, the mounting plate 6 may be provided with tabs on the backside for direct attachment to the support arm 4.

Furthermore, although this particular embodiment describes the speaker system as installed in the rear seat package tray, it may, of course, be imbedded in the door panel.

Another embodiment of the present invention will be further described in conjunction with FIGS. 5 through 13.

Figure 5:
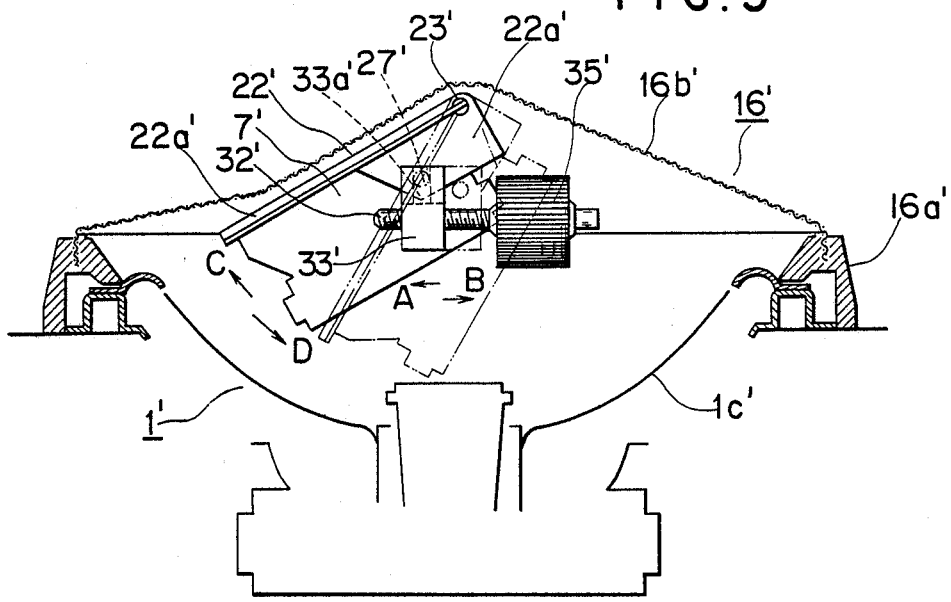
FIG. 5 is a schematic cross sectional view of another embodiment of the present invention.
Figure 13:
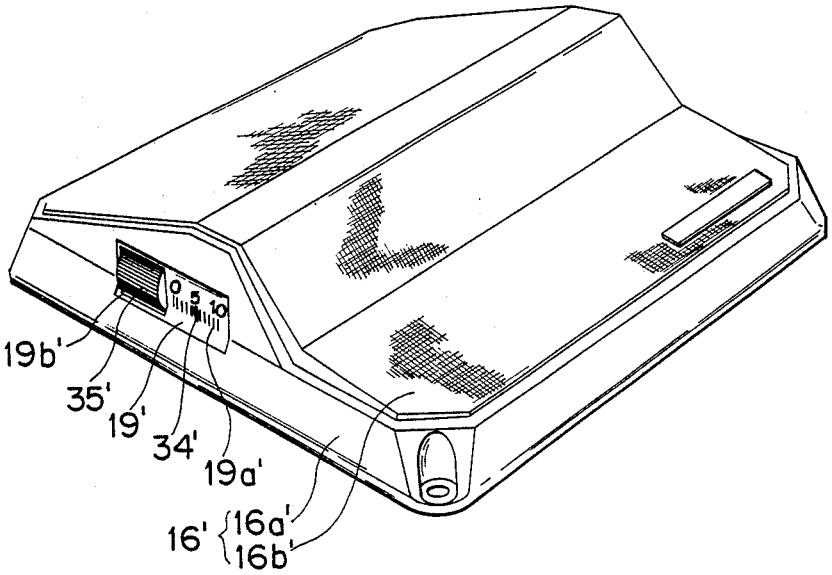
FIG. 13 is a top view of the general structure of the embodiment of FIG. 5.

FIG. 5 is a schematic cross sectional view of a compound speaker system equipped with the angle adjustment mechanism of the present invention. FIG. 13 is a perspective view of such speaker system.

The grille 16' is provided for attachment in front of the woofer 1' and comprises a side frame portion 16*a'* that is sized large enough to enclose the cone 1*c'* of the woofer 1', and a grille or an upper net cover 16*b'*, which may be made of punched metal or any other suitable material, that is defined by the side frame portion 16*a'* at its all sides.

Figure 6:
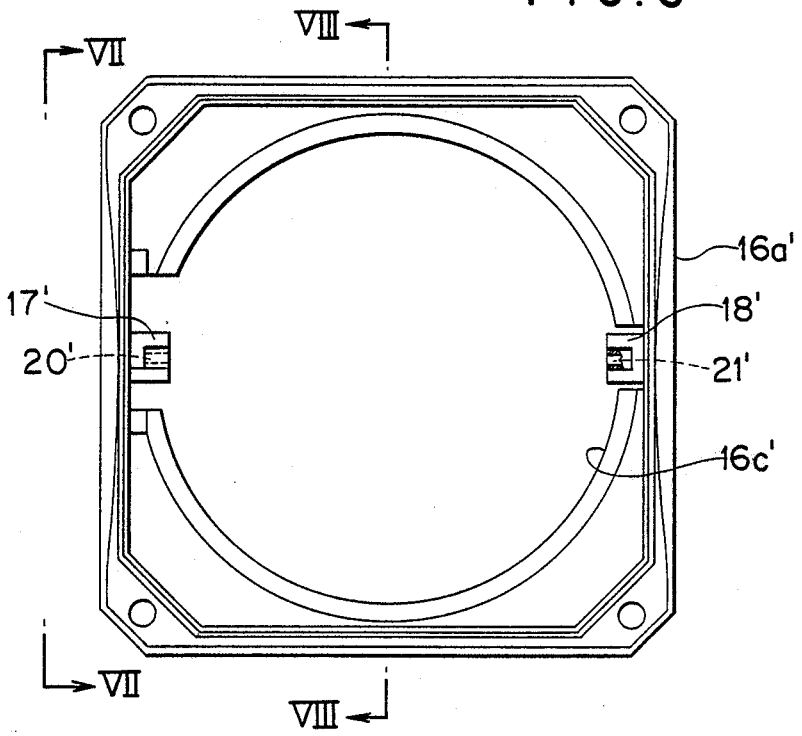
FIG. 6 is a plan view of a grille, which form part of the embodiment of FIG. 5 and an upper portion of which is partially omitted for an illustrative purpose.

The side frame portion 16*a'* is largely square in shape as viewed from in front of the woofer, as can best been seen in FIG. 6. The side frame portion has in the center an opening 16*c'* of diameter substantially equal to that of the diaphragm 1*c'*. The side frame portion 16*a'* is provided with bearing portions 17' and 18' at opposite points in the sides thereof.

Figure 7:
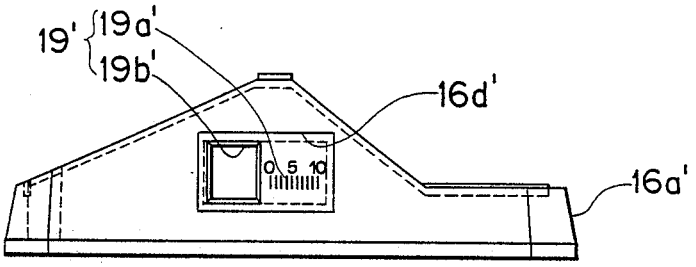
FIG. 7 is a side elevation of the grille viewed from line VII—VII of FIG. 6.
Figure 8:
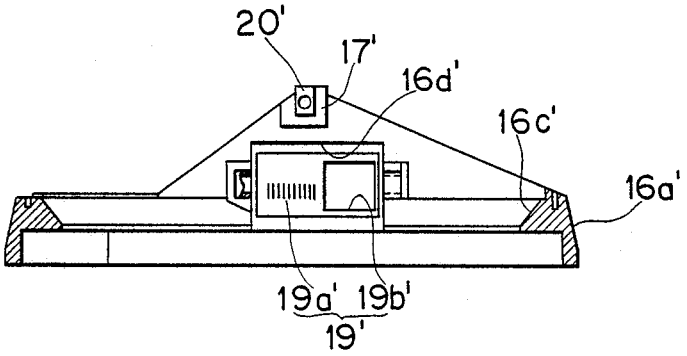
FIG. 8 is a cross sectional view taken along line VIII—VIII of FIG. 6.

As shown in FIGS. 7 and 8, the side frame portion 16*a'* is also provided with an aperture 16*d'* at a mid point in the side panel that has the bearing portion 17' on the inside wall. A transparent acrylic resin plate 19' is fitted in the aperture 16*d'*. The acrylic plate 19' has an opening 19*b'* and a graduated area 19*a'* in it.

Each of the bearing portions 17' and 18' is fitted with a bearing element 20' or 21'. On the grille 16' is rotatably disposed a support member 22' through the bearing elements 20' and 21' in a manner as will be explained. That is, the support member 22' has at opposite ends thereof a pair of shoulder plates 22*a'* 22*b'* to each of which a main shaft 23' is affixed at an upper end portion thereof. The main shafts 23' are inserted into the bearing elements 20' and 21' respectively axially rotatably as indicated by chain line l in FIG. 9A.

Figure 9A:
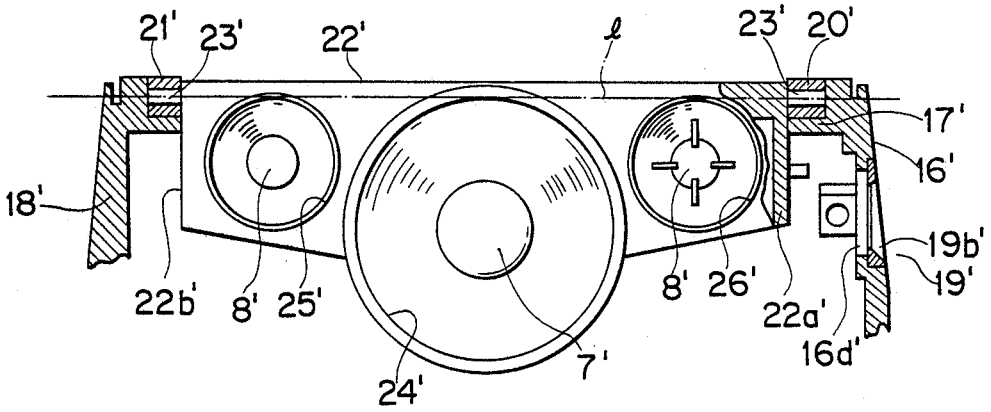
FIG. 9A is a partially fragmental front view of a support member used in the embodiment of FIG. 5.
Figure 9B:
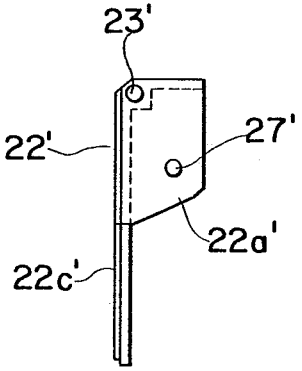
FIG. 9B is a side view of the same support member.

The support member 22 has a cross section of largely L-shape, as is shown in FIG. 9B, with a vertical section 22*a'* that is increasingly wider toward the middle portion thereof and tapering toward the opposite ends thereof. The vertical portion 22*a'* is formed with a supporting hole 24' of large diameter in the middle portion. In this supporting hole 24' is fitted a squawker 7'. A pair of supporting holes 26' and 27' of small diameter are formed in the vertical portion 22*a'* at both end portions. In each of the supporting holes 25' and 26' is supported a tweeter 8'.

In this manner, the squawker 7' and tweeter 8' are pivotably mounted on the support member 22' within a space enclosed by the grille 16' and the diaphragm 1*c'*. The angle adjustment mechanism for varying the angle of the vertical axis of these speaker units is constructed as follows.

Figure 10:
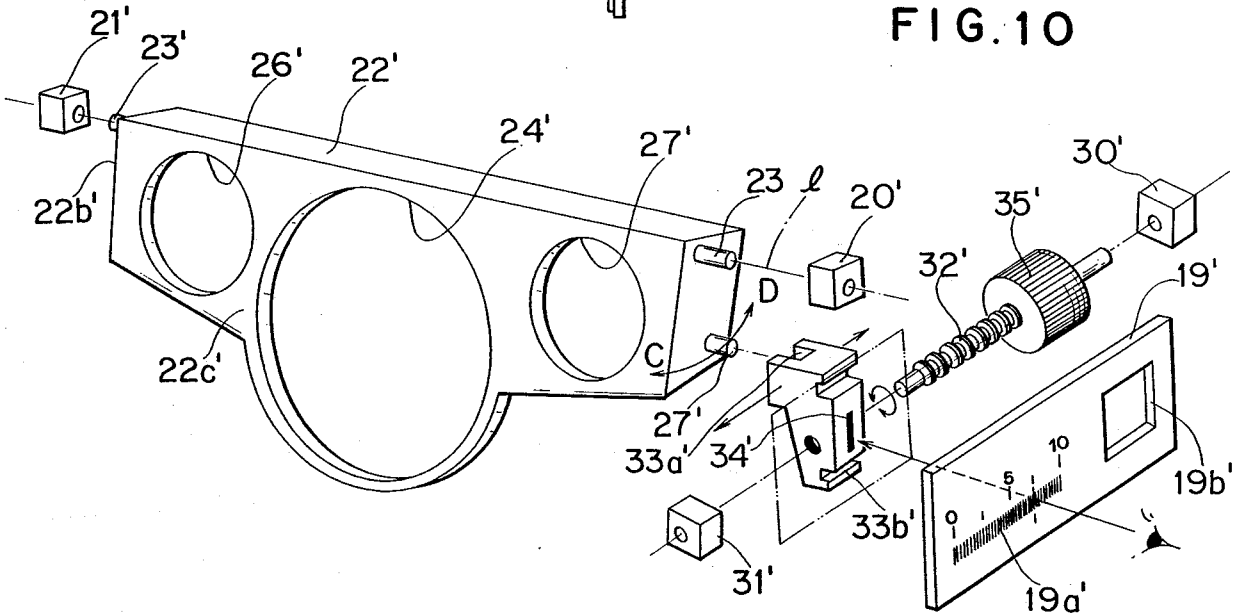
FIGS. 10 through 12 are exploded perspective views of important portions of the embodiment of FIG. 5.
Figure 11:
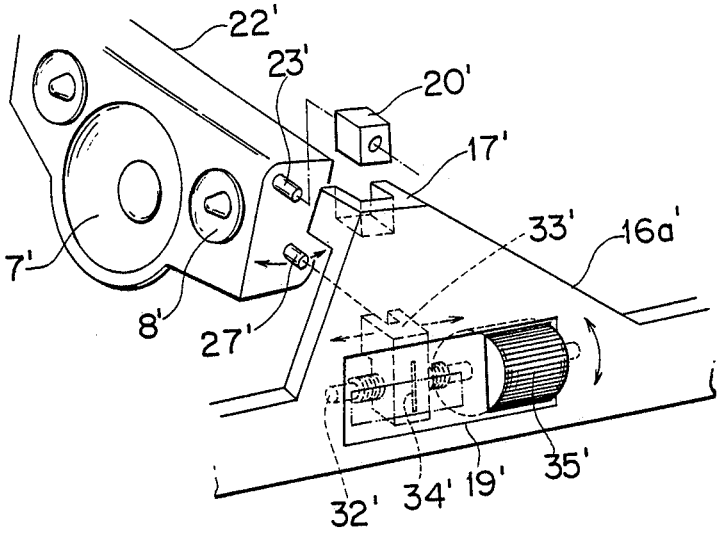
Figure 12:
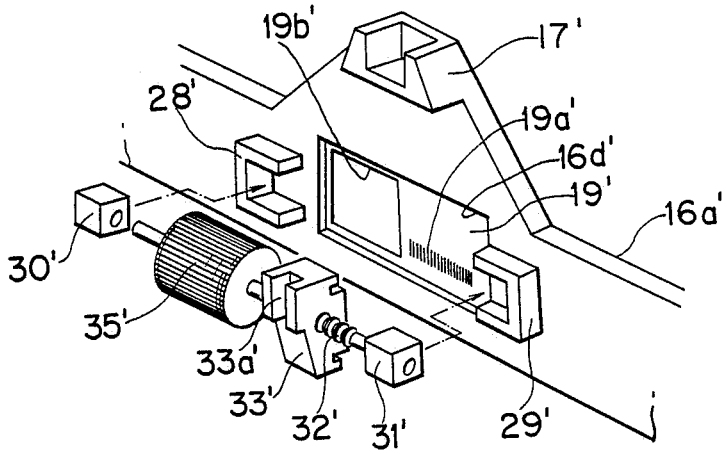

As is minutely depicted in FIGS. 10 through 12, which are exploded views of an associated part, the support member 22' has, on a lower end of one of the shoulder plates 22*c'*, situated adjacent to the opening 16*d'*, an engagement pin 27' whose axis l is parallel to the axis 1 of rotation of the support member. The side frame portion 16' has on the inside surface a pair of bearing sleeves 28' and 29' on opposite ends of the opening 19*b'*. Each of the bearing sleeves 28' and 29' is equipped with a bearing element 30' or 31'. Between the bearing elements is rotatably fitted a threaded actuator shaft 32'. The threaded actuator shaft 32' extends in a direction substantially perpendicular to axis l of rotation of the support member 22'. A control member 33' is screw-threaded by the threaded actuator shaft 32' for linear movement on it. When the threaded actuator shaft 32' is rotated, the control member 33' moves in a direction perpendicular to axis l of rotation of the support member. The control member 33' has on its front surface facing the engagement pin 27' an engagement slit **33*a* that extends perpendicular to the axis l of rotation of the support member and to the axis of the threaded actuator shaft 32'. In the engagement slit 33*a'* is slidably engaged the engagement pin 27'. With this arrangement, the linear movement of the control member 33' is converted to a swing motion of the support member 22'**.

When the control member 33' is being actuated by rotation of the threaded actuator shaft 32', the control member may rotate itself about the axis of the threaded actuator shaft 32' without moving along it. Provision should be made, therefore, to prevent the control member 33' from rotation. For example, the control member 33' may be formed on the surface facing the acrylic resin plate 19' with a guide groove **33*b'*. The side frame 16*a* is formed on the inside surface a matched guide rail (not shown) for receiving the guide groove 33*b'*. As an alternative means, the control member may have its rear end extended further for sliding contact with the acrylic resin plate 19'**.

Also, the control member 33' has an indicator line 34' on the rear surface. The indicator line 34' is superimposed on the graduated area **19*a'* on the acrylic resin plate 19'** for reading from the outside.

A knob 35' is fixedly mounted on the threaded actuator shaft 32' adjacent to the control member 33'. The knob 35' protrudes partly out of the grille 16 through the opening **19*b'* in the acrylic resin plate 19'. The knob 35'** is serrated on the circumference for easy manipulation.

Operation of the preferred embodiment of which the construction has been described will be explained.

When the threaded actuator shaft 32' is rotated in one direction through the knob 35', the control member 33' is moved along the threaded actuator shaft 32' in the direction of the arrow A in FIG. 5 or 10. This movement of the control member 33 causes the support member 22' to rotate about the axis of rotation l in the direction indicated by the arrow C in the same drawing. When the threaded actuator shaft 32' is rotated in the opposite direction, the control member 33' is moved in the direction indicated by the arrow B in the drawing. In this case, the control member 33' causes the support member 22' to rotate about the axis l in the direction indicated by the arrow D. The rotation of the support member affects the angle of installation of the squawker 7' and the tweeters 8', and is read on the graduated area **19*a'*, on which the indicator line 34' gives reading of what angle the speaker units takes. Graduation helps to ensure an accurate control of the speaker units angle for better sound propagation. The control member 33' not only functions to control the angle of the speakers but also serves to hold the support member 22'** in locked position during performance and prevent the speakers from accidental rotation due to impact or vibration.

In this particular embodiment, as has been stated above, the support member 22' has on one of the shoulder plates **22*a'* the engagement pin 27' for engagement into an engagement slit 33*a'* formed on the control member 33' for the purpose of converting the linear movement of the control member 33' into a rotational motion of the support member 22'. However, it should be understood that this illustration is not intended to limit the present invention to such a method of motional conversion, and that various versions would be derived. For example, the control member 33' may be provided with an arm for contact with the support member 22' in such a manner that enables the arm to cause the support member 22' to swing back and forth according as the control member 33'** is actuated.

Furthermore, the angle adjustment mechanism of this embodiment can also be used for controlling the sound transmission direction from the squawker or the tweeter(s) in a compound speaker system.

A has been stated, the present invention is directed to the compound speaker arrangement in which the squawker unit is rotatable between a raised and a lowered position in the middle of the woofer magnetic circuit, with the tweeter mounted next to it. It is so designed that, when the squawker is raised, the tweeter situates itself at a higher point than the squawker. This design has several advantages. For example, the highly directional high frequency range sound propagate from higher in space than the less highly directional mid-range sound. The driver can enjoy sound without loss of fidelity.

What is claimed is:

1. A compound speaker system comprising:

a woofer having a cone which has an upper rim extending in a plane, said woofer facing in a first direction generally perpendicular to said plane;

magnetic circuit means which faces said cone at a center portion thereof;

a squawker of a smaller size than said woofer;

holding means for holding said squawker within said cone, said squawker being rotatable about a predetermined axis to locate said squawker in a plurality of positions such that each position corresponds to a direction at an angle to said first direction, said predetermined axis being parallel to said plane of said upper rim of said woofer;

a mounting plate attached to a periphery of said squawker, said mounting plate extending outside said plane when said squawker is rotated about said predetermined axis, said mounting plate being attached opposite to the cone of the woofer above said plane; and a tweeter attached to said mounting plate to face in substantially the same direction as said squawker, a first diametral line of said tweeter, which is parallel to said predetermined axis, being offset from said predetermined axis and being non-coaxial with a first diametral line of said squawker, said first diametral line of said squawker being parallel to said predetermined axis, a second diametral line of said tweeter, which is perpendicular to said predetermined axis, being non-coaxial with a second diametral line of said squawker, said second diametral line of said squawker being perpendicular to said predetermined axis.

2. A compound speaker system according to claim 1, wherein said holding means includes a base mounted to said magnetic circuit means and extending within said cone at the center thereof; and largely U-shaped support arm rotatably holding said squawker and secured to said base at a bottom thereof.

3. A compound speaker system according to claim 2, further including locking means between said squawker and said base to lock the squawker in each of said positions.

4. A compound speaker system according to claim 1, further including cam actuator means provided in association with said holding means; cam means actuated by said cam actuator means to move in a perpendicular direction to said predetermined axis; and cam follower means attached to said holding means.

5. A compound speaker system according to claim 4, wherein said holding means includes a cover for the woofer, said cover having a side frame portion to support said cam actuator means and said cam means thereon; and a support member to support the squawker and the tweeter, said side frame portion axially rotatably receiving the support member.

6. A compound speaker system according to claim 5, wherein said side frame portion has a window therein to manipulate said cam actuator means from outside the cover.

7. A compound speaker system according to claim 6, wherein said actuator means includes a knob positioned for axial rotation within the cover and having a threaded actuator shaft axially extending in a direction perpendicular to said predetermined axis and protruding in part through said window from within, said cam means including a control member adapted to travel on said threaded actuator shaft; said cam follower means including an engagement pin extending from said support member, said control member having an elongated slit to receive said engagement pin.

8. A compound speaker system according to claim 7, wherein said side frame portion has an indicator window therein, said indicator window being formed of a transparent acrylic resin plate and having a graduated area therein, said control member having an indicator line visible through said graduated area from outside the cover.

9. A compound speaker system according to claim 1 further including a super tweeter attached to said mounting plate to face in substantially the same direction as said squawker and tweeter, a first diametral line of said super tweeter, which is parallel to said predetermined axis, being offset from said predetermined axis and being non-coaxial with said first diametral line of said tweeter, a second diametral line of said super tweeter, which is perpendicular to said predetermined axis, being non-coaxial with said second diametral line of said tweeter.

10. A compound speaker system comprising:

low-pitched sound reproducing means including a woofer having a cone which has an upper rim extending in a plane and facing in a first direction;

magnetic circuit means which faces said cone at a center portion thereof;

high-pitched sound reproducing means including at least one of a squawker, a tweeter and a super tweeter, said high-pitched sound reproducing means having a size generally smaller than said low-pitched sound reproducing means, said high-pitched sound reproducing means being disposed within said cone of said woofer;

attaching means for attaching said high-pitched sound reproducing means to said cone above said plane and opposite to said cone rotatably about a predetermined axis to take positions such that said high-pitched sound reproducing means faces, in each of said positions, in a second direction at an angle with said predetermined direction, said high-pitched sound reproducing means being positioned to reproduce highly directional high-pitched sound outside said plane in each of said positions, wherein a first diametral line of said tweeter, which is parallel to said predetermined axis, being offset from said predetermined axis and being non-coaxial with a first diametral line of said squawker, said first diametral line of said squawker being parallel to said predetermined axis, a second diametral line of said tweeter, which is perpendicular to said predetermined axis, being non-coaxial with a second diametral line of said squawker, said second diametral line of said squawker being perpendicular to said predetermined axis, and wherein a first diametral line of said super tweeter, which is parallel to said predetermined axis, being offset from said predetermined axis and being non-coaxial with said first diametral line of said tweeter, a second diametral line of said super tweeter, which is perpendicular to said predetermined axis, being non-coaxial with said second diametral line of said tweeter;

a cam actuator means provided in association with said attaching means;

a cam means actuated by said cam actuator means to move in a perpendicular direction to said predetermined axis; and cam follower means attached to said attaching means.

11. A compound speaker system according to claim 10, wherein said attaching means includes a cover for the woofer, said cover having a side frame portion to support said cam actuator means and said cam means thereon; and a support member to support the squawker and the tweeter, said side frame portion axially rotatably receiving the support member.

12. A compound speaker system according to claim 11, wherein said side frame portion has a window therein to manipulate said cam actuator means from outside the cover.

13. A compound speaker system according to claim 12, wherein said actuator means includes a knob positioned for axial rotation within the cover and having a threaded actuator shaft axially extending in a direction perpendicular to said predetermined axis and protruding in part through said window from within, said cam means including a control member adapted to travel on said threaded actuator shaft; said cam follower means including an engagement pin extending from said support member, said control member having an elongated slit to receive said engagement pin.

14. A compound speaker system according to claim 13, wherein said side frame portion has an indicator window therein, said indicator window being formed of a transparent acrylic resin plate and having a graduated area therein, said control member having an indicator line visible through said graduated area from outside the cover.

15. A compound speaker system comprising:

a woofer having a cone which has an upper rim extending in a plane, said woofer facing in a first direction generally perpendicular to said plane;

magnetic circuit means which faces said cone at a center portion thereof;

a squawker of a smaller size than said woofer;

holding means for holding said squawker within said cone, said squawker being rotatable about a predetermined axis to locate said squawker in a plurality of positions such that each position corresponds to a direction at an angle to said first direction, said predetermined axis being parallel to said plane;

a mounting plate attached to a periphery of said squawker, said mounting plate extending above said plane when said squawker is rotated, said mounting plate being attached opposite to the cone of the woofer above said plane;

a tweeter and a super tweeter attached to said mounting plate to face in substantially the same direction as said squawker, said tweeter and said super tweeter being rotated in the same direction as said squawker about said predetermined axis within said cone of said woofer, wherein a first diametral line of said tweeter, which is parallel to said predetermined axis, being offset from said predetermined axis and being non-coaxial with a first diametral line of said squawker, said first diametral line of said squawker being parallel to said predetermined axis, a second diametral line of said tweeter, which is perpendicular to said predetermined axis, being non-coaxial with a second diametral line of said squawker, said second diametral line of said squawker being perpendicular to said predetermined axis, and wherein a first diametral line of said super tweeter, which is parallel to said predetermined axis, being offset from said predetermined axis and being non-coaxial with said first diametral lines of said tweeter and said squawker, a second diametral line of said super tweeter, which is perpendicular to said predetermined axis, being non-coaxial with said second diametral lines of said tweeter and said squawker;

cam actuator means provided in association with said holding means, said cam actuator means including a knob position for axial rotating within a cover and having a threaded actuator shaft axially extending in a direction perpendicular to said predetermined axis and protruding in part through a window;

cam means actuated by said cam actuator means to move in a perpendicular direction to said predetermined axis, said cam means including a control member to travel on said threaded actuator shaft;

a support member to support said squawker and said tweeter and super tweeter; and a cam follower means attached to said holding means, said cam follower means including an engagement pin extending from said support member, said control member having a elongated slit to receive said engagement pin.

16. A compound speaker system comprising:

low-pitched sound reproducing means including a woofer having a cone which has an upper rim extending in a plane and facing in a first direction;

magnetic circuit means which faces said cone at a center portion thereof;

high-pitched sound reproducing means including at least one of a squawker, a tweeter and a super tweeter, said high-pitched sound reproducing means having a size generally smaller than said low-pitched sound reproducing means, said high-pitched sound reproducing means being disposed within said cone of said woofer;

attaching means for attaching said high-pitched sound reproducing means to said cone above said plane and opposite to said cone rotatably about a predetermined axis to take positions such that said high-pitched sound reproducing means faces, in each of said positions, in a second direction at an angle with said predetermined direction, said high-pitched sound reproducing means being positioned to reproduce highly directional high-pitched sound outside said plane in each of said positions, wherein a first diametral line of said tweeter, which is parallel to said predetermined axis, being offset from said predetermined axis and being non-coaxial with a first diametral line of said squawker, said first diametral line of said squawker being parallel to said predetermined axis, a second diametral line of said tweeter, which is perpendicular to said predetermined axis, being non-coaxial with a second diametral line of said squawker, said second diametral line of said squawker being perpendicular to said predetermined axis, and wherein a first diametral line of said super tweeter, which is parallel to said predetermined axis, being offset from said predetermined axis and being non-coaxial with said first diametral lines of said tweeter and said squawker, a second diametral line of said super tweeter, which is perpendicular to said predetermined axis, being non-coaxial with said second diametral lines of said tweeter and said squawker;

a cam actuator means provided in associated with said attaching means;

cam means actuated by said cam actuator means to move in a perpendicular direction to said predetermined axis and cam follower means attached to said attaching means; and a support member to support said squawker and said tweeter and super tweeter, said cam actuator means including a knob position for axial rotation within a cover and having a threaded actuator shaft axially extending in a direction perpendicular to said predetermined axis and protruding in part from a window, said cam means including a control member to travel on said threaded actuator shaft, said cam follower means including an engagement pin extending from said support member, said control member having an elongated slit to receive said engagement pin.

17. A compound speaker system according to claim 9 wherein said first diametral line of said super tweeter being non-coaxial with said first diametral of said squawker and wherein said second diametral line of said super tweeter being non-coaxial with said second diametral line of said squawker.

* * * * *